US010875740B1

(12) United States Patent
Santaite et al.

(10) Patent No.: US 10,875,740 B1
(45) Date of Patent: Dec. 29, 2020

(54) WALL-MOUNTED RETRACTABLE HOLSTER

(71) Applicants: Kevin Santaite, Lunenburg, MA (US); Victor Mariotti, Lunenburg, MA (US)

(72) Inventors: Kevin Santaite, Lunenburg, MA (US); Victor Mariotti, Lunenburg, MA (US)

( * ) Notice: Subject to any disclaimer, the term of this patent is extended or adjusted under 35 U.S.C. 154(b) by 71 days.

(21) Appl. No.: 16/372,509

(22) Filed: Apr. 2, 2019

(51) Int. Cl.
*B65H 75/48* (2006.01)
*B65D 25/22* (2006.01)

(52) U.S. Cl.
CPC ..... *B65H 75/486* (2013.01); *B65D 25/22* (2013.01); *B65H 2403/47* (2013.01)

(58) Field of Classification Search
CPC ..... B65H 75/486; B65H 75/48; B65H 75/34; B65D 85/04; B65D 25/22; B65D 25/20
USPC ..... 220/483, 481, 480, 476, 737; 224/162; 248/318, 579; 242/170, 371
See application file for complete search history.

(56) References Cited

U.S. PATENT DOCUMENTS 2,679,709 A * 6/1954 Du Bois ..... A47K 5/05 248/579
5,094,396 A 3/1992 Burke
5,316,249 A 5/1994 Anderson
D412,706 S 8/1999 Virost
6,502,727 B1 * 1/2003 Decoteau ..... A45F 5/004 224/162
7,665,684 B2 2/2010 Salentine
8,220,676 B1 7/2012 Hicks
9,586,787 B2 3/2017 Okamoto
2010/0264176 A1 10/2010 Snell

FOREIGN PATENT DOCUMENTS

WO 2007103959 9/2007

* cited by examiner

*Primary Examiner* — Robert J Hicks

(57) ABSTRACT

The wall-mounted retractable holster comprises a holster, a tether, and a retractor. The retractor may retrieve a retrievable object that is coupled to the tether so that the retrievable object may be stored in the holster. As non-limiting examples, the retrievable object may be a remote control or a cell phone. The end of the tether may attach to the retrievable object via a device attachment located at one end of a tether cord. The other end of the tether cord may be wrapped around a spool within the retractor. A pawl and ratchet may allow the tether cord to be pulled out of the retractor but may prevent the cord from being pulled into the retractor unless a retract button on the retractor is activated. The spool may be spring loaded so that the cord is pulled in automatically when the retractor button is activated.

16 Claims, 4 Drawing Sheets

WALL-MOUNTED RETRACTABLE HOLSTER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of personal organizers, more specifically, a wall-mounted retractable holster.

SUMMARY OF INVENTION

The wall-mounted retractable holster comprises a holster, a tether, and a retractor. The retractor may retrieve a retrievable object that is coupled to the tether so that the retrievable object may be stored in the holster. As non-limiting examples, the retrievable object may be a remote control or a cell phone. The end of the tether may attach to the retrievable object via a device attachment located at one end of a tether cord. The other end of the tether cord may be wrapped around a spool within the retractor. A pawl and ratchet may allow the tether cord to be pulled out of the retractor but may prevent the cord from being pulled into the retractor unless a retract button on the retractor is activated. The spool may be spring loaded so that the cord is pulled in automatically when the retractor button is activated.

An object of the invention is to retrieve an object when a retractor button is activated.

Another object of the invention is to store the retrieved object in a holster that may be mounted to a wall.

A further object of the invention is to provide a spring that automatically pulls the tether cord into the retractor and wraps the cord around a spool when the retractor button is activaed.

Yet another object of the invention is to provide a pawl and ratchet that allows a tether cord to be pulled out of the retractor but prevents the spring from pulling the object back without activating the retractor button.

These together with additional objects, features and advantages of the wall-mounted retractable holster will be readily apparent to those of ordinary skill in the art upon reading the following detailed description of the presently preferred, but nonetheless illustrative, embodiments when taken in conjunction with the accompanying drawings.

In this respect, before explaining the current embodiments of the wall-mounted retractable holster in detail, it is to be understood that the wall-mounted retractable holster is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wall-mounted retractable holster.

It is therefore important that the claims be regarded as including such equivalent construction insofar as they do not depart from the spirit and scope of the wall-mounted retractable holster. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
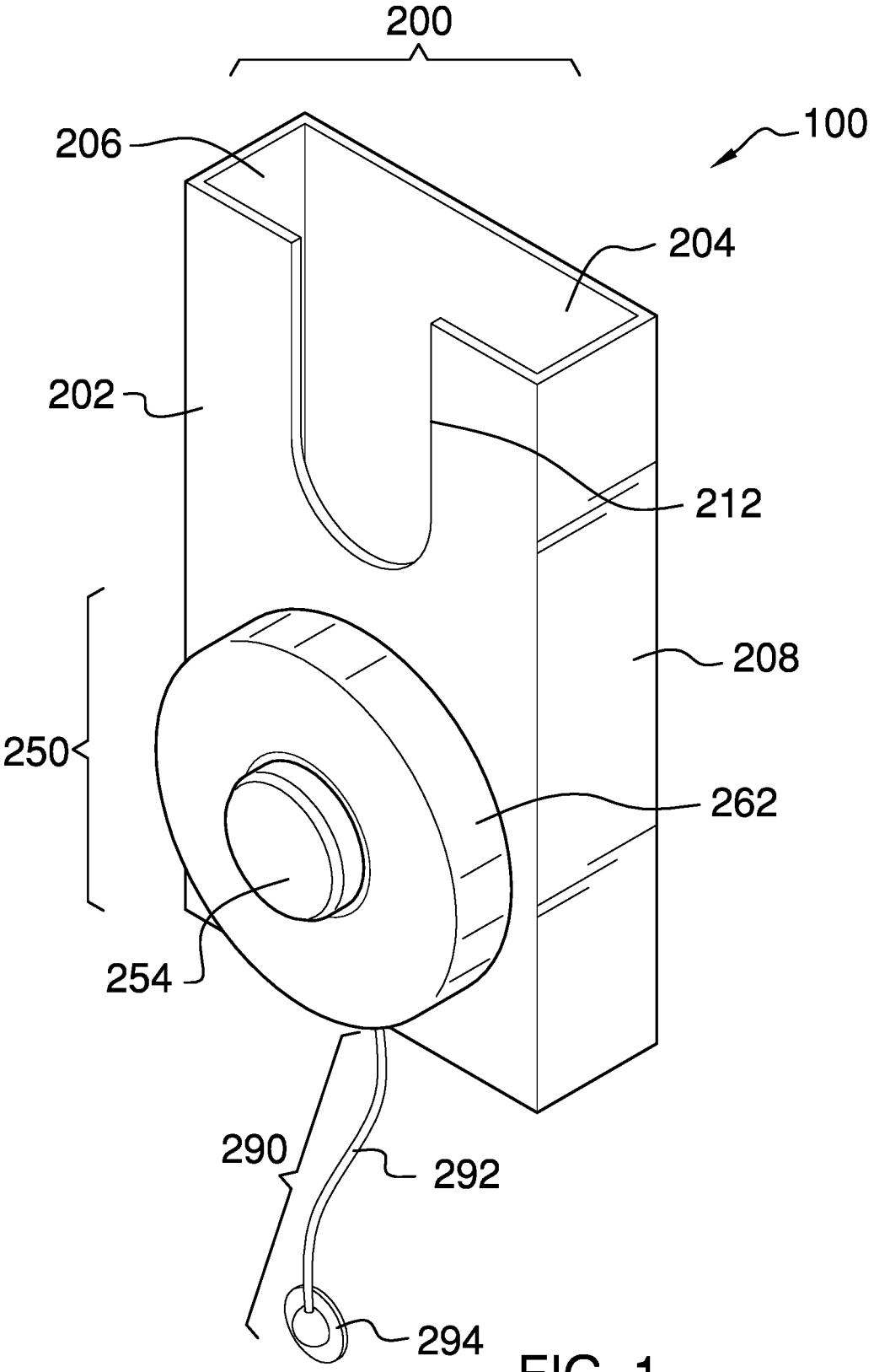
FIG. 1 is a perspective view of an embodiment of the disclosure.
Figure 2:
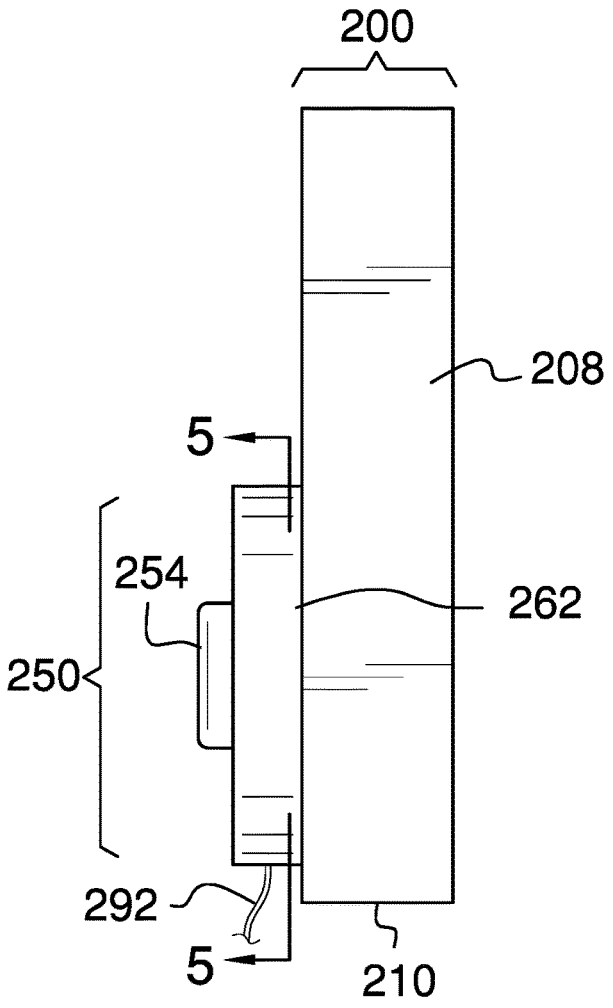
FIG. 2 is a side view of an embodiment of the disclosure.
Figure 3:
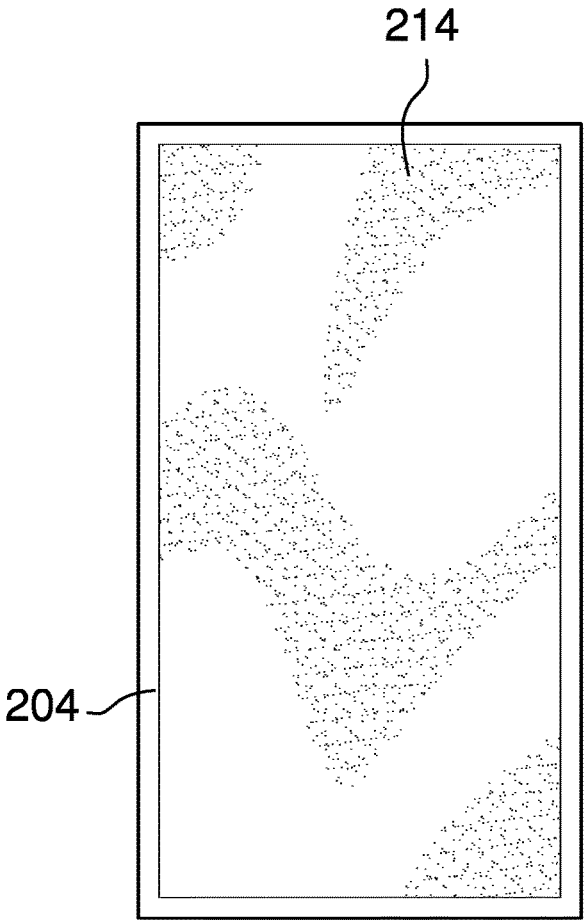
FIG. 3 is a rear view of an embodiment of the disclosure.
Figure 4:
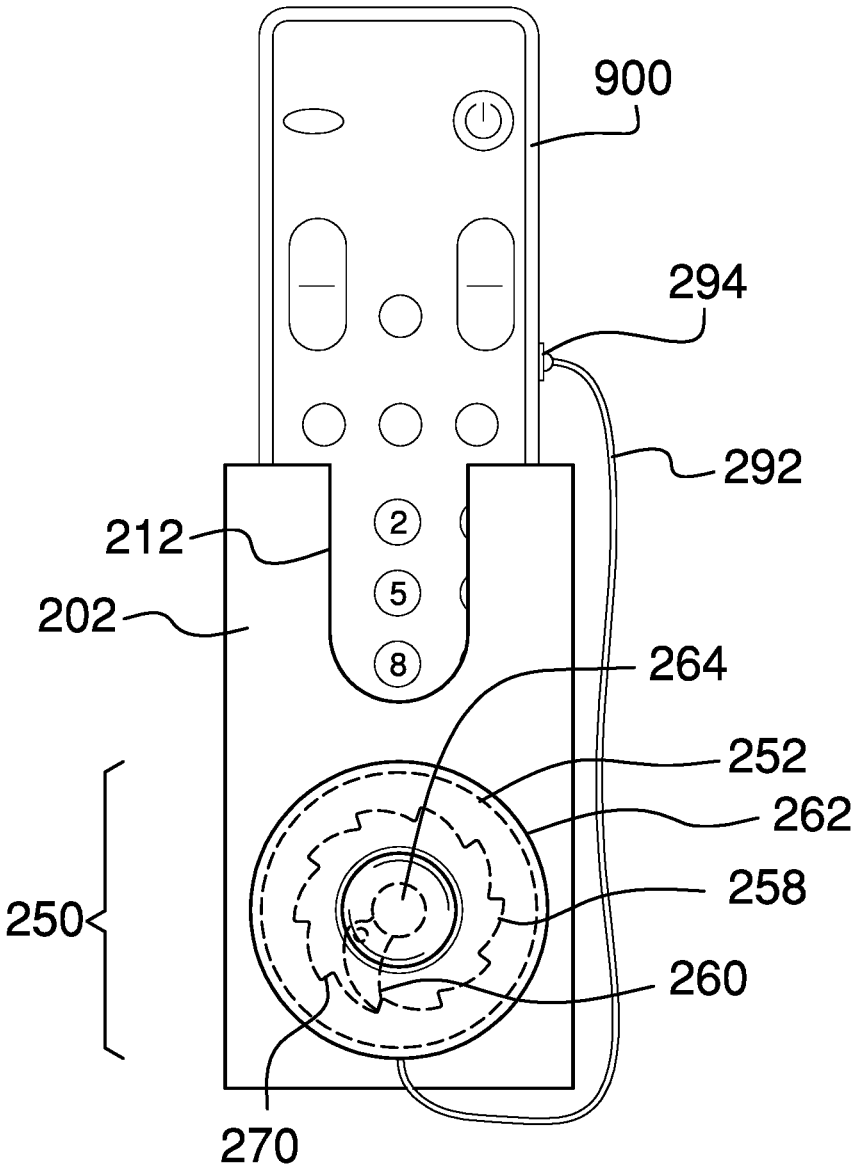
FIG. 4 is an in-use view of an embodiment of the disclosure.
Figure 5:
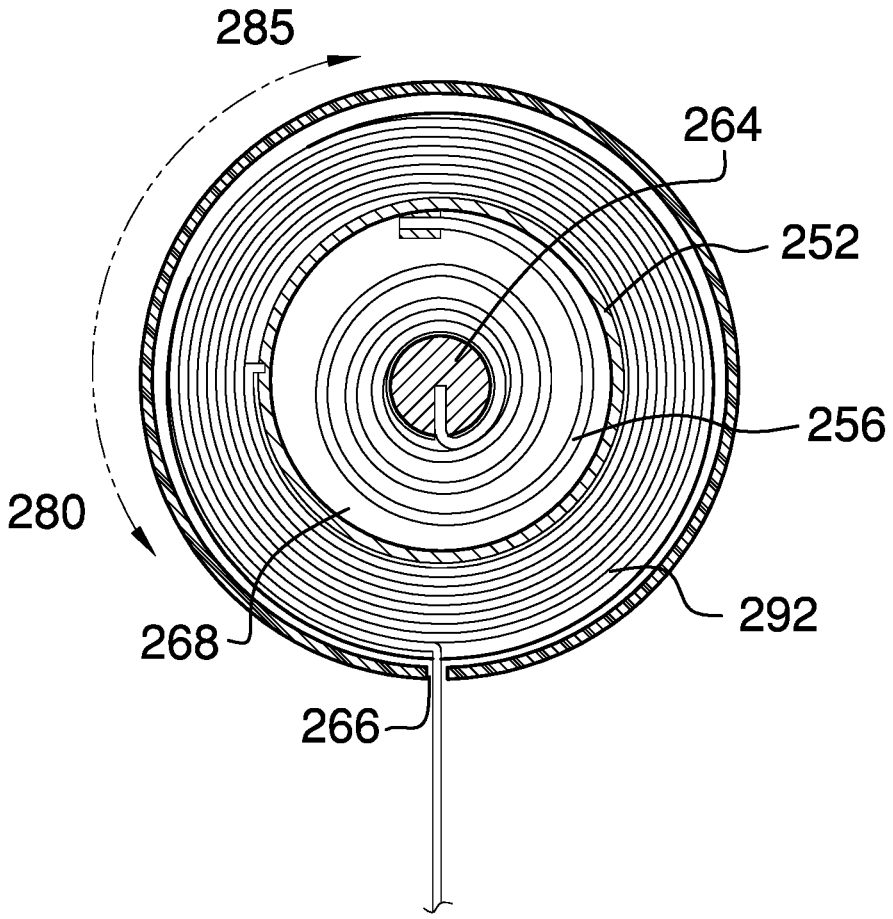
FIG. 5 is a cross-sectional view of an embodiment of the disclosure across 5-5 as shown in FIG. 2.

Detailed reference will now be made to a first potential embodiment of the disclosure, which is illustrated in FIGS. 1 through 5.

The wall-mounted retractable holster 100 (hereinafter invention) comprises a holster 200, a tether 290, and a retractor 250. The retractor 250 may retrieve a retrievable object 900 that is coupled to the tether 290 such that the retrievable object 900 may be stored in the holster 200. As non-limiting examples, the retrievable object 900 may be a remote control or a cell phone.

The holster 200 may comprise a front wall 202, a rear wall 204, a left side wall 206, a right side wall 208, a bottom wall 210, and a coupler 214. The holster 200 may be an open-top container for holding the retrievable object 900. The left edge of the front wall 202 may be coupled to the front edge of the left side wall 206. The right edge of the front wall 202 may be coupled to the front edge of the right side wall 208. The bottom edge of the front wall 202 may be coupled to the front edge of the bottom wall 210. The left edge of the rear wall 204 may be coupled to the rear edge of the left side wall 206. The right edge of the rear wall 204 may be coupled to the rear edge of the right side wall 208. The bottom edge of the rear wall 204 may be coupled to the rear edge of the bottom wall 210. The bottom edge of the left side wall 206 may be coupled to the left edge of the bottom wall 210. The bottom edge of the right side wall 208 may be coupled to the right edge of the bottom wall 210. The retractor 250 may be coupled to the front surface of the front wall 202. The front wall 202 may comprise an access cutout 212. The access cutout 212 may be a notch at the top center of the front wall 202. The access cutout 212 may provide access to grasp the retrievable object 900 that is stored within the holster 200.

The coupler 214 may attach the holster 200 to a mounting surface. As non-limiting examples, the mounting surface may be a wall or a piece of furniture.

The tether 290 may comprise a cord 292 and a device attachment 294. The tether 290 may couple the retractor 250 to the retrievable object 900. The cord 292 may be flexible material that is coupled to a spool 252 at one end of the cord 292 and is coupled to the device attachment 294 at the opposite end of the cord 292. The device attachment 294 may be a fastener that couples the cord 292 to the retrievable object 900. In some embodiments, the device attachment 294 may couple to the retrievable object 900 using suction or an adhesive.

The retractor 250 may comprise the spool 252, an axle 264, a ratchet 258, a pawl 260, a spring 256, a retract button 254, a housing 262, and a tether aperture 266. The retractor 250 may organize the tether 290 when the tether 290 is not extended. The tether 290 may be extended from within the retractor 250 by pulling on the tether 290. The tether 290 may be recalled into the retractor 250 by activating the retract button 254 on the retractor 250.

The spool 252 may be a reel which the cord 292 wraps around when the tether 290 is not extended. The spool 252 may be cylindrical and may comprise a central spool aperture 268. The spool 252 may be free to rotate around the axle 264 which passes through the central spool aperture 268. The axle 264 may be coupled to the front wall 202 of the holster 200, to the housing 262 or to both.

The ratchet 258 may be a wheel comprising angled teeth 270. The ratchet 258 may be coupled to the spool 252. The angled teeth 270 may engage the pawl 260 such that the ratchet 258 is free to rotate in a first direction 280 and is prevented from rotating in a second direction 285 unless the pawl 260 is disengaged.

The pawl 260 may be a pivoting, curved bar whose free end engages the angled teeth 270 of the ratchet 258. The pawl 260 may pivot as the ratchet 258 rotates in the first direction 280, thus allowing the ratchet 258 to rotate. The pawl 260 may not pivot as the ratchet 258 rotates in the second direction 285, thus preventing the ratchet 258 from rotating.

The spring 256 may be coupled to the spool 252 at one end of the spring 256 and to the axle 264 at the opposite end of the spring 256. The spring 256 may cause the spool 252 to rotate in the second direction 285, causing the cord 292 to pull into the retractor 250 and to wrap around the spool 252.

The retract button 254 may cause the pawl 260 to disengage from the ratchet 258, thus allowing the ratchet 258 to turn in the second direction 285. The retract button 254 may be activated to disengage the pawl 260 by pressing the retract button 254.

The housing 262 is a covering for the spool 252 and the ratchet 258. The retract button 254 passes through the front surface of the housing 262. The rear of the housing 262 may couple to the front surface of the front wall 202. The tether aperture 266 may be an aperture in the housing 262. The tether 290 may exit and enter the housing 262 via the tether aperture 266.

In use, the holster 200 may be attached to the mounting surface using the coupler 214 on the rear wall 204 of the holster 200. As non-limiting examples, the mounting surface may be the wall or the piece of furniture and the coupler 214 may be a self-adhesive strip. The device attachment 294, which may be located at the end of the tether 290 that is outside of the housing 262, may be attached to the retrievable object 900. As non-limiting examples, the retrievable object 900 may be the remote control or the cell phone.

To use the retrievable object 900, a user may grasp the retrievable object 900 and pull on it. Responsive to being pulled, the tether 290 may cause the spool 252 to rotate in the first direction 280, which the ratchet 258 and the pawl 260 will permit, and the tether 290 may extend from within the housing 262. When the user stops pulling, the spring 256 will attempt to turn the spool 252 in the second direction 285. The ratchet 258 and the pawl 260 will not permit the spool 252 to rotate in the second direction 285 and the retrievable object 900 may be released without being pulled by the tether 290.

To reclaim the retrievable object 900 for storage, the user may press the retract button 254 to disengage the pawl 260. With the pawl 260 disengaged, the spring 256 may cause the spool 252 to rotate in the second direction 285, pulling the tether 290 back into the housing 262 and wrapping the cord 292 around the spool 252. As the tether 290 is pulled into the housing 262, the retrievable object 900 may be dragged back to the holster 200 and the user may place the retrievable object 900 into the holster 200.

DEFINITIONS

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used in this disclosure, an "axle" is a cylindrical shaft that is inserted through the center of an object such that the center axis of the object and the center axis of the axle are aligned and the object can rotate using the axle as an axis of rotation.

As used herein, the words "couple", "couples", "coupled" or "coupling", refer to connecting, either directly or indirectly, and does not necessarily imply a mechanical connection.

As used in this disclosure, "flexible" refers to an object or material which will deform when a force is applied to it, which will not return to its original shape when the deforming force is removed, and which may not retain the deformed shape caused by the deforming force.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, a "housing" is a rigid casing that encloses and protects one or more devices.

As used in this disclosure, a "notch" is an indentation formed in an edge or a cavity or aperture formed within a surface.

As used in this disclosure, a "ratchet" is a device comprising a pawl or hinged catch that engages the sloping teeth of a wheel or bar permitting motion in one direction only. A "ratcheting mechanism" is a device that incorporates a ratchet. "Ratcheting motion" refers to motion along a ratcheting mechanism.

As used herein, a "reel" refers to a cylindrical object with side walls around which a wire, filament, thread, cord, cable, string, line, rope, hose, tubing, or other rope-like object is wound.

As used in this disclosure, a "spool" is a cylindrical device upon which a flexible material, including but not limited to a rope, a cable, a yarn, a cord, or a tape, can be wound. Depending on context, a spool may also contain the flexible material stored upon the spool.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, a "tether" is a cord, line, webbing, or strap that is attached to an object to restrict movement.

As used in this disclosure, a "wheel" is a circular object that revolves around an axle or an axis and is fixed below an object to enable it to move easily over the ground.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventors claim:

1. A wall-mounted retractable holster comprising:

a holster, a tether, and a retractor;

wherein the retractor retrieves a retrievable object that is coupled to the tether such that the retrievable object is stored in the holster;

wherein the holster comprises a front wall, a rear wall, a left side wall, a right side wall, a bottom wall, and a coupler;

wherein the holster is an open-top container for holding the retrievable object;

wherein the left edge of the front wall is coupled to the front edge of the left side wall;

wherein the right edge of the front wall is coupled to the front edge of the right side wall;

wherein the bottom edge of the front wall is coupled to the front edge of the bottom wall;

wherein the left edge of the rear wall is coupled to the rear edge of the left side wall;

wherein the right edge of the rear wall is coupled to the rear edge of the right side wall;

wherein the bottom edge of the rear wall is coupled to the rear edge of the bottom wall;

wherein the bottom edge of the left side wall is coupled to the left edge of the bottom wall;

wherein the bottom edge of the right side wall is coupled to the right edge of the bottom wall;

wherein the retractor is coupled to the front surface of the front wall.

2. The wall-mounted retractable holster according to claim 1 wherein the front wall comprises an access cutout;

wherein the access cutout is a notch at the top center of the front wall;

wherein the access cutout provides access to grasp the retrievable object that is stored within the holster.

3. The wall-mounted retractable holster according to claim 2 wherein the coupler attaches the holster to a mounting surface.

4. The wall-mounted retractable holster according to claim 3 wherein the tether comprises a cord and a device attachment;

wherein the tether couples the retractor to the retrievable object.

5. The wall-mounted retractable holster according to claim 4 wherein the cord is flexible material that is coupled to a spool at one end of the cord and is coupled to the device attachment at the opposite end of the cord.

6. The wall-mounted retractable holster according to claim 5 wherein the device attachment is a fastener that couples the cord to the retrievable object.

7. The wall-mounted retractable holster according to claim 6 wherein the device attachment couples to the retrievable object using suction or an adhesive.

8. The wall-mounted retractable holster according to claim 6 wherein the retractor comprises the spool, an axle, a ratchet, a pawl, a spring, a retract button, a housing, and a tether aperture;

wherein the retractor organizes the tether when the tether is not extended.

9. The wall-mounted retractable holster according to claim 8 wherein the tether is extended from within the retractor by pulling on the tether;

wherein the tether is recalled into the retractor by activating the retract button on the retractor.

10. The wall-mounted retractable holster according to claim 9 wherein the spool is a reel which the cord wraps around when the tether is not extended;

wherein the spool is cylindrical and comprises a central spool aperture;

wherein the spool is free to rotate around the axle which passes through the central spool aperture;

wherein the axle is coupled to the front wall of the holster, to the housing or to both.

11. The wall-mounted retractable holster according to claim 10 wherein the ratchet is a wheel comprising angled teeth;

wherein the ratchet is coupled to the spool;

wherein the angled teeth engage the pawl such that the ratchet is free to rotate in a first direction and is prevented from rotating in a second direction unless the pawl is disengaged.

12. The wall-mounted retractable holster according to claim 11 wherein the pawl is a pivoting, curved bar whose free end engages the angled teeth of the ratchet;

wherein the pawl pivots as the ratchet rotates in the first direction, thus allowing the ratchet to rotate;

wherein the pawl does not pivot as the ratchet rotates in the second direction, thus preventing the ratchet from rotating.

13. The wall-mounted retractable holster according to claim 12 wherein the spring is coupled to the spool at one end of the spring and to the axle at the opposite end of the spring;

wherein the spring causes the spool to rotate in the second direction, causing the cord to pull into the retractor and to wrap around the spool.

14. The wall-mounted retractable holster according to claim 13 wherein the retract button causes the pawl to disengage from the ratchet, thus allowing the ratchet to turn in the second direction;

wherein the retract button is activated to disengage the pawl by pressing the retract button.

15. The wall-mounted retractable holster according to claim 14 wherein the housing is a covering for the spool and the ratchet;

wherein the retract button passes through the front surface of the housing;

wherein the rear of the housing couples to the front surface of the front wall.

16. The wall-mounted retractable holster according to claim 15 wherein the tether aperture is an aperture in the housing;

wherein the tether exits and enter the housing via the tether aperture.

* * * * *